US005203967A

United States Patent [19]

Bando et al.

[11] Patent Number: 5,203,967

[45] Date of Patent: Apr. 20, 1993

[54] TWIN-WIRE FORMER IN A PAPER MACHINE

[75] Inventors: Takashi Bando; Kazuhide Sakamoto; Hiromu Masuda; Hiroyuki Fuchioka, all of Mihara, Japan

[73] Assignee: Mitsubishi Jukogyo Kabushiki Kaisha, Tokyo, Japan

[21] Appl. No.: 809,133

[22] Filed: Dec. 18, 1991

[30] Foreign Application Priority Data

Dec. 19, 1990 [JP] Japan ..... 2-403649

[51] Int. Cl.[5] ..... D21F 1/00

[52] U.S. Cl. ..... 162/301; 162/300; 162/352

[58] Field of Search ..... 162/300, 301, 303, 352

[56] References Cited

U.S. PATENT DOCUMENTS

| | | | |
|---|---|---|---|
| 3,992,254 | 11/1976 | Lehtinen | 162/301 |
| 3,994,774 | 11/1976 | Halme et al. | 162/301 |
| 4,609,435 | 9/1986 | Tissari | 162/352 |
| 4,714,521 | 12/1987 | Fujiwara | 162/301 |
| 4,734,164 | 3/1988 | Irwin et al. | 162/352 |
| 5,074,966 | 12/1991 | Koivuranta | 162/301 |

FOREIGN PATENT DOCUMENTS

| | | |
|---|---|---|
| 3217860 | 12/1982 | Fed. Rep. of Germany . |
| 3842155 | 6/1990 | Fed. Rep. of Germany . |
| 3910892 | 10/1990 | Fed. Rep. of Germany . |

*Primary Examiner*—Karen M. Hastings

*Attorney, Agent, or Firm*—Wenderoth, Lind & Ponack

[57] ABSTRACT

In a twin-wire former in a paper machine, an operation of a hybrid former mode and that of a gap former mode are conducted, and papers of quality conforming to the kind of papers can be made in a wide range of basis weight with regard to multiple kinds of papers.

In the twin-wire former, a forming roll, which guides a top wire so that it can approach to a bottom wire to pinch the stock of paper and run approximately horizontally, is made adjustable in an up and down direction.

Upper surfaces of blades of a forming board and a forming shoe provided inside a loop of the bottom wire, are upwardly convex so that dewatering can be effected mainly downward.

4 Claims, 3 Drawing Sheets

TWIN-WIRE FORMER IN A PAPER MACHINE

BACKGROUND OF THE INVENTION

The present invention relates to a twin-wire former in a paper machine which pinches the stock between horizontal running portions of the upper and lower wire loops to dewater the stock.

In a twin-wire former of a conventional paper machine, each of two wires respectively form a loop, and while the stock is pinched between the wires, the stock is dewatered by various dewatering devices so that a fiber mat is gradually grown and a web is formed.

In FIGS. 6 and 7, two typical twin-wire formers are shown. In the twin-wire former shown in FIG. 6, a top wire 2' is engaged with a bottom wire 1' corresponding to a conventional long net used as a Fourdrinier wire so that upward dewatering can be additionally performed, and this type of former is referred to as an on-top-former or a hybrid-former. Stock 14 is injected from a head box 5' to a location between a breast roll 3 and a forming board 6'. While conveyed on the forming board 6', a foil 11, and a vacuum foil box 12, the stock 14 is dewatered downward and a mat is formed from the side of the stock facing downward. After that, the stock 14 is pinched by the two wires in a gap 13' which is formed by the top wire 2' and the bottom wire 1' on a forming shoe 7', and then the stock 14 is dewatered mainly upward by tension caused by the two wires and pulse pressure generated in a portion of the forming shoe 7'.

An advantage of the aforementioned former is that since the former is provided with a Fourdrinier wire type of preforming zone before the stock 14 is pinched between the top wire loop 2' and the bottom wire loop 1', a paper of high quality can be made which has high strength in a thickness direction so that a degree of orientation (a ratio of longitudinal to lateral tensile strength) is low. On the other had, the aforementioned former has the following drawbacks. The stock 14 in the preforming zone has a free surface. Accordingly, when the stock 14 is conveyed at high speed, air resistance and an agitation effect caused by the foil become excessive, so that the surface of the stock is disturbed and jumping occurs. Therefore, the operation becomes difficult, and a deterioration in paper quality such as degradation in the formation and increase in the air permeability are caused.

In the former shown in FIG. 7, a bottom wire 1'' and a top wire 2'' are engaged with each other immediately after a breast roll 3 and a forming roll 4 so that a wedge-shaped gap 13 is formed. Accordingly, this type of former is referred to as a gap former or a true twin-wire former because it is not provided with a Fourdrinier wire type preforming zone. Stock 14 injected from a head box 5 is pinched by the two wires in the gap 13 located immediately after the breast roll 3 and the forming roll 4. Then, the stock 14 is dewatered simultaneously upward and downward due to the squeezing effect by the wire tension and pulse pressure acting on the stock 14 in a forming shoe 7'' arranged after the gap 13.

An advantage of this former is that pulse-like dewatering pressure acts on the stock from when the stock concentration is low, so that a good mat can be formed. Further, this former is characterized in that the operation can be conducted at high speed since the stock injected from the head box 5 is immediately pinched by the two wires; and the stock does not flow laterally in the preforming zone, so that the angle of orientation of the stock injected from the head box can be maintained to obtain a paper in which the angle of orientation in the width direction is uniform. On the other hand, in this former, when the thickness of stock is large (that is, when the concentration is low), the stock is pinched by the two wires, so that the degree of orientation (the ratio of longitudinal to lateral tensile strength) becomes high by the pressure generated when the stock is pinched. Further, this former has a drawback in that since the stock is dewatered toward both sides by pulse-like pressure applied during an initial stage of dewatering, the ratio of dewatering to the upper and lower sides becomes approximately 50/50, so that the binding strength in a middle layer of the mat is lowered, and the strength in the thickness direction of the paper becomes low.

As explained above, the twin wire former which has been used as a mainstream of formers nowadays has merits and demerits. Therefore the type of a former is selected in accordance with the kind of paper and the characteristics thereof desired.

That is, in the case of newspaper, the formation and speed of fabrication are important, so that a gap former is utilized. A hybrid former is mainly used in the case of middle and high class paper such as information paper (a PPC paper) in which high lateral rigidity is required (a low ratio of tensile strength is required) in order to improve the running property when the paper is used in a copier, and in which a low curling property (a difference in nature between its front and rear surfaces is small, and an angle of orientation is small) is required, and such as coating paper in which a high strength in the thickness direction is required in order to mitigate a problem caused by blisters.

Especially in the latter case, the required quality of the paper, to which priority is given, is different case by case, and at the same time the formation, which is an essential quality of paper, and high speed, i.e. high productivity is manufacture, are required. Consequently, when these various kinds of papers are made by one former, a compromise between the various qualities required for the different types of paper must necessarily occur.

SUMMARY OF THE INVENTION

It is therefore an object of the present invention to provide a twin-wire former which can operate under both a gap former mode and a hybrid former mode so that various kinds of paper can be made under optimum conditions.

To achieve the above object, the twin-wire former comprises an adjacent wire running section in which a looped top wire and a looped bottom wire confront each other and run approximately horizontally at an equal speed pinching the stock of paper injected from a head box so as to dewater said stock, wherein a forming roll for guiding said top wire to said adjacent wire running section is adjustable in up and down directions.

The twin-wire former further includes a forming board and a forming shoe on a downstream side of said forming board in the wire running direction, each of which is provided in said adjacent wire running section in a loop of the bottom wire, the upper surface of a blade located at a tip of said forming board on an upstream side in the wire running direction being upwardly convex, and the upper surface of successive blades being flat, and the upper surface of a blade located at a tip of said forming shoe on an upstream side in the wire running direction and the upper surface presented by successive blades being respectively upwardly convex, and the radius of curvature of the latter being larger than that of the former.

A relation between the radius of curvature $R_1$ of the upper surface of the blade located at the tip of said forming board, and radiuses of curvature $R_2$, $R_3$ of the upper surface of the shoe located at the tip of said forming shoe and the arc in which the upper surfaces of the successive shoes lie, can be expressed by $R_1<R_2<R_3$.

Accordingly, the forming roll which guides the top wire pinching the stock of paper together with the bottom wire in the adjacent wire running section, can be adjusted in up and down directions. Accordingly, when the forming roll is located in a lower position, the stock is pinched by the top and bottom wires, so that the former operates under a gap former operation mode. On the other hand, when the forming roll is located in an upper position, the two wire which is guided by the forming roll runs while separated from the bottom wire, so that the stock is conveyed on the bottom wire in this portion. Then, the top wire approaches the bottom wire, and the stock is pinched by both wires, so that the former operates under a hybrid former operation.

In the aforementioned gap former operation mode, before the surface of the stock is disturbed, the stock is pinched by the two wires because the forming roll is located in the lower position. This stock is dewatered upward on the blade of the tip of the forming board by the action of wire tension. After that, dewatering is not effected upward since the upper surface of the successive blades is flat, so that dewatering is effected only downward and the stock is agitated to prevent the reoccurrence of floc. Since the upper surface of the tip of the forming board is upwardly convex as described above, the stock of paper is smoothly pinched by the two wires. In the successive forming shoe, a radius of curvature of the collection of blades located on the downstream side in the wire running direction is larger than that of the blade located on the upstream side, so that dewatering of the stock by wire tension is inhibited at the blades located on the downstream side. Consequently, an intense shoe effect is generated and dewatering is effected downward. In the manner described above, dewatering is effected mainly downward until the stock reaches a successive forming zone, and the reoccurrence of fiber floc can be prevented.

Because a relation between the radius of curvature R of the upper surface of the blade located at the tip of the forming board, and radiuses of curvature $R_2$, $R_3$ of the upper surface of the blade located at the tip of said forming shoe and that of the arc in which the upper surfaces of the successive blades lies satisfies $R_1<R_2<R_3$, upwardly dewatering effected by the forming shoe can be further inhibited, and downward dewatering can be further improved.

DETAILED DESCRIPTION OF THE PREFERRED EMBODIMENTS

Figure 1:
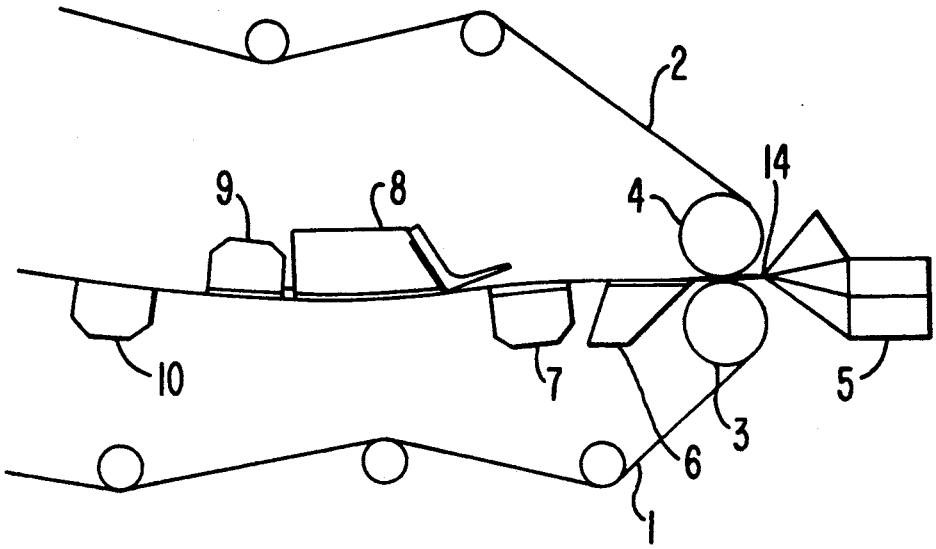
FIG. 1 is a schematic view of the first embodiment of a twin wire former according to the present invention.

Now the present invention will be described in greater detail in connection with the preferred embodiments of the invention illustrated in FIG. 1 to FIG. 3. Numerals 1 and 2 respectively designate a loop-shaped bottom and top wire. The bottom wire 1 is wound around a breast roll 3, and the top wire 2 is wound around a forming roll 4. While stock 14 is pinched between the two wires, the bottom wire 1 and top wire 2 run approximately horizontally at an equal speed. Numeral 5 is a head box which injects the stock 14 toward a space between the aforementioned breast roll 3 and forming roll 4. A forming board 6 and a first forming shoe 7 are provided in that order in a loop of the bottom wire 1 downstream of the breast roll 3 in the wire running direction (referred to as a downstream side or the upstream side and omitting the term of "in the wire running direction", hereinafter). A second forming shoe 8 and a suction box 9 are provided in that order in a loop of the top wire 2 on the downstream side of the first forming shoe 7, and a suction box 10 is provided in a loop of the bottom wire 1 on the downstream side of the suction box 9.

Figure 2:
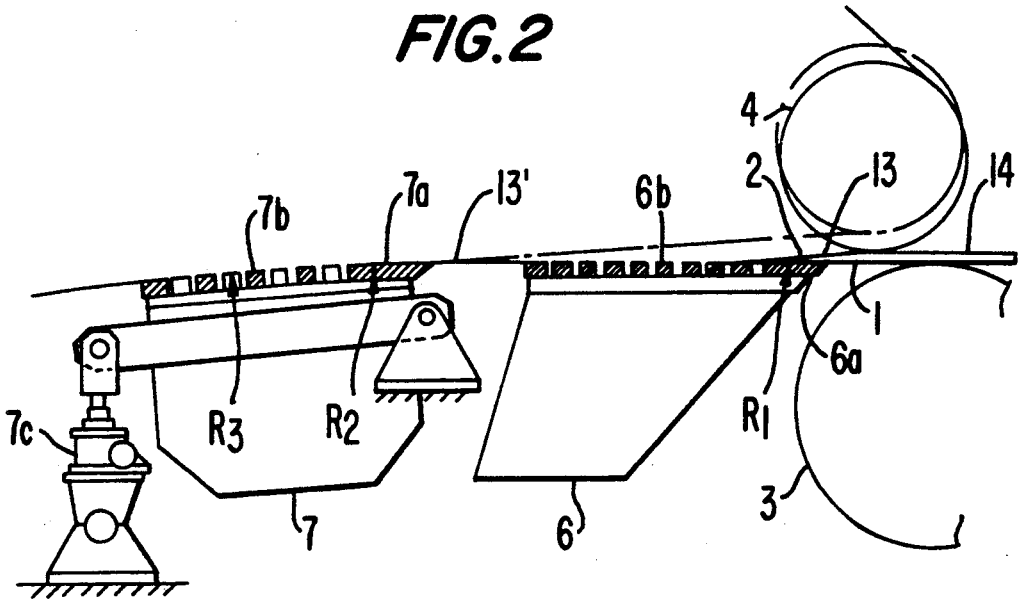
FIG. 2 is a side view in detail of an essential portion of the first embodiment of the present invention.

As illustrated in FIG. 2, the aforementioned forming roll 4 can be adjustably moved between a solid line and one-dot-chain line position in the up and down direction by a drive means not shown in the drawing.

The forming board 6 comprises a first blade **6*a* located on the upstream side and a plurality of detachable narrow blades 6*b* provided on the downstream side. The upper surface of the first blade 6*a* is upwardly convex (protruded upward) forming a curved surface of radius of curvature $R_1$. The upper surfaces of the plurality of blades 6*b* lie in the same plane so that they form a flat surface. The first forming shoe 7 comprises a first blade 7*a* on the upstream side and a plurality of narrow detachable blades 7*b* provided on the downstream side. The upper surface of the first blade 7*a* is curved in such a manner that it is upwardly convex (protruded upward) and the radius of curvature is $R_2$, and the upper surfaces of the plurality of blades 7*b* are curved in such a manner that they present an upwardly convex (protruded upward) surface having the radius of curvature $R_3$. The values of $R_1$, $R_2$ and $R_3$ are set such that $R_1<R_2<R_3$. The first forming shoe 7 is supported by an adjusting device 7*c* so that it can be rotated around a portion close to the tip of the first blade 7*a*. Further, a vacuum acts on the forming board 6 and the first forming shoe 7**.

Figure 3:
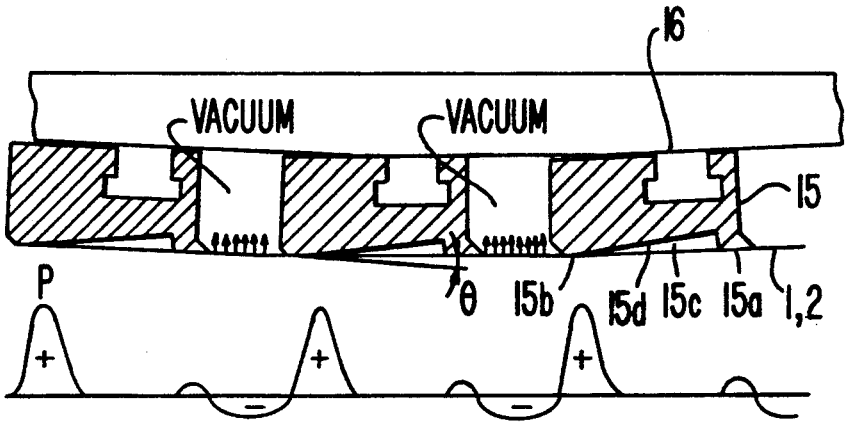
FIG. 3 is a longitudinal section view of the second forming shoe of the first embodiment of the present invention.

As shown in FIG. 3, the second forming shoe 8 is provided with a plurality of shoe blades 15. Each shoe blade 15 is provided with a tip **15*a* at the upstream side thereof which comes into contact with the top wire 2, an inclined portion 15*d* which is located downstream of the aforementioned tip 15*a* such that a wedge-shaped space 15*c* is defined between the inclined portion 15*d*** and the top wire 2 (the depth of the wedge-shaped space 15c decreasing in the downstream direction), and a rear end portion 15b which is located downstream of the inclined portion 15d and which contacts the top wire 2. Each blade 15 has such a structure that the top wire 2 which runs while in contact with the aforementioned tips 15a and end portions 15b is curved downward by an angle Θ. Spaces are formed between the blades 15 which are adjacent to each other, and a minimum vacuum acts on the second forming shoe 8 so that the wires 1, 2 and the blade 15 can be sealed at the tip 15a. Each blade 15 is detachably inserted into a T-bar 16, as shown in FIG. 3.

Each operation mode of this embodiment having the aforementioned structure will now be explained.

1. In the case of newsprint, the important quality of which is the formation and difference in nature between the front and rear surfaces.

When the forming roll 4 is set to a lower position shown by a solid line in Fog. 2, the wires 1 and 2 converge upon the surface of the first blade 6a of the forming board 6 so that a gap 13 is formed. Consequently, the stock 14 injected from the head box 5 is pinched between the wires 1 and 2 before its surface is disturbed and a free surface of the stock 14 can exist, so that the operation can be conducted at high speed. A relative speed generated between an upper outer layer of the stock 14 and the top wire 2 and that generated between a lower outer layer and the bottom wire 1 are the same at gap 13, so that a paper can be made having a little difference in the degree of orientation. In this case, the first blade 6a of the forming board 6 protrudes upward forming a curved surface having radius of curvature $R_1$, so that the stock 14 can be smoothly pinched between the wires 1 and 2.

When the stock pinched between the two wires 1, 2 passes the detachable blades 6b which are arranged approximately horizontally, and the upper surfaces of which are flat, the reoccurrence of floc of fiber can be prevented because the upper surfaces of the blades 6b are flat and the stock 14 is appropriately agitated by a vacuum applied to the forming board 6.

Next, when the stock 14 passes over the detachable blades 7b which are arranged on the first forming shoe 7 in such a manner that the blades 7b form a curved surface of which the radius of curvature is $R_3$, fibers in the stock 14 are dispersed again by pulse-like pressure applied to the stock, so that a good formation can be formed. The pressure given to the stock can be changed when a vacuum acts on the forming shoe 7 or when only every other blade 7b is provided as shown by a hatched portion in FIG. 2. Since the first forming shoe 7 is supported in such a manner that it can be rotated around a portion close to the tip of the first blade 7a by the adjusting device 7c, the rear end position can be changed in accordance with the thickness of the stock advancing to the second forming shoe arranged on the downstream.

As shown in FIG. 3, in a portion of the twin wire former proximate the second forming shoe 8, upward dewatering is facilitated by a suction effect produced by a vacuum, that a fine fiber distribution can be obtained which has a little difference in nature between both surfaces of the paper. Each shoe blade 15 defines a space 15c of a depth which decreases in the downstream direction, and the wires 1, 2 are bent at the rear end portion 15b. Accordingly, as shown in FIG. 3, a pressure pulse (shown by sign + in FIG. 3) directed toward the bottom wire 1 side is generated at the tip of the rear end portion 15b, and water which has been sucked from the stock 14 into the wedge-shaped space 15c, runs together with the wire and is pushed back to the wire side by the action of the wedge-shaped space 15c, so that downward dewatering can be effected and a yield of fibers can be improved. An amount of fine fibers in portions close to the top and bottom surface can be finely adjusted by controlling a vacuum value inside the suction boxes 9 and 10.

2. In the case of low areal weight coat paper made at high speed, the strength in the thickness direction and low air-permeability of which are important.

In order to operate the machine at high speed, a gap forming mode operation is conducted in the same manner as the aforementioned case 1. However in the case of coat paper, strength in the thickness direction and low air-permeability are given priority over the formation and difference in nature between both surfaces of paper. Accordingly, the following points are effective in this operation mode. That is, after the stock 14 injected from the head box 5 has been dewatered upward on the first blade 6a of the forming board 6 due to the top wire tension, the stock 14 is hardly dewatered upward since the upper surfaces of the blades 6b lie in a common plane and dewatering is effected only by the squeezing effect of the two wires 1 and 2.

The radius of curvature $R_2$ of the upper surface of the first blade 7a is larger than that $R_1$ of the upper surface of the first blade 6a of the forming board 6, so that upper dewatering is decreased. When all of the successive blades 7b are utilized, a peak value of pulse-shaped pressure generated on the blades 7b can be reduced, so that upper dewatering can be also decreased there in addition to the crease in upper dewatering caused by the upper surface presented by the blades 7b which has a larger radius of curvature than radiuses of curvature $R_1$, $R_2$ of the upper side blades 6a, 7a. Consequently, even though the stock 14 passing the forming board 6 and the first forming shoe 7 is pinched by the two wires, an operation can be performed in which upper dewatering is reduced to the minimum.

Next, in the second forming shoe 8 which is a main paper layer forming place, only a vacuum of a necessary minimum pressure is generated in a space between the blades 15 so that the wire and blade can be sealed at the front edge 15a of the blade 15. On the other hand, the wires 1, 2 ate bent at the rear end 15b of the blade 15, and therefore dewatering pressure acts on the stock between the two wires. In the same manner as the aforementioned case 1, the wedge-shaped space 15c formed between the top wire 2 and blade 15 is filled with water which has been obtained during dewatering, so that the generated water pressure acts as a back pressure. Therefore, dewatering toward the blade 15 side can be inhibited. Consequently, dewatering is mainly effected downward in the second forming shoe 8, too. As described above, despite the structure being that of a twin-wire former, dewatering is mainly effected downward so that a dewatering ratio can be biased. Accordingly, paper in which the strength in the thickness direction thereof is high can be obtained.

In a portion of the second forming shoe 8, it is necessary to dewater downward using a pulse having a high peak value in order to redisperse fibers. At that time, a mat has already been formed by a gentle downward dewatering action conducted on the upstream side, and further the bottom wire 2, which is on the dewatering side, is not rubbed by the shoe plate 15, so that fine fibers do not fall off a paper of low air-permeability can be obtained. In this case, the function and effect of the suction boxes 9, 10 are the same as in the aforementioned case 1.

3. (a) In the case of information paper (PPC paper) in which low tensile strength, minimal differences in nature between both surfaces of the paper, and a small angle of orientation are important.

3. (b) In the case of high basis weight coat paper in which strength in the thickness direction is important.

When the forming roll 4 is set to an upper position indicated by a one-dot-chain line in FIG. 2, the top wire 2 is first engaged with the bottom wire 1 at the first blade 7*a* of the first forming shoe 7, so that a gap 13' can be formed. On the forming board 6, the top wire 2 is completely separated from the stock 14 and a Fourdrinier wire type preforming board is formed, and an operation of hybrid mode is performed.

In this case, in order to avoid a difference in relative speed between the wire and the stock which is caused when the stock 14 is pinched by the two wires 1 and 2 immediately after the stock 14 has been injected from the head box 5 and has landed on the wires, a J/W ratio (a ratio of wire speed to jet speed), which is one of the parameters to control the fiber orientation at a stock landing point, is made to be 1.00 (that is, the jet speed is made to coincide with the wire speed). In the aforementioned manner, paper of a small degree of orientation (a ratio of longitudinal tensile strength and lateral tensile strength) can be made.

When thick coat paper is made, it is necessary to make a lip open large. In this case, when the operation is conducted according to the gap mode, the stock 14 is not sufficiently taken into the gap by the wires, and the difference in relative speed between the wires and the stock becomes too large, so that a harmful effect would be brought about. In this case, the operation should be conducted in the aforementioned hybrid mode, and the stock, the thickness of which is reduced by facilitating downward dewatering at the forming board section 6, should be sent to the gap portion.

The function and effect of each unit in the aforementioned operation mode will be further explained as follows. When the stock 14 injected from the head box 5 lands on the wire at the first blade 6*a* of the forming board 6 in such a manner that the stock jet is tangent to the blade surface, a reaction force is minimized, and disturbance in the stock is also minimized. Since the upper surfaces of the successive blades 6*b* are arranged in one flat plane, the stock 14 is not separated from the bottom wire 1 and conveyed to the first forming shoe 7. When the stock 14 is conveyed into the gap 13 without disturbing the free surface as above, problems such as an entrainment of air in the gap are prevented.

After that, a dewatering pressure caused by top wire tension acts on the stock 14 pinched by the two wires in the gap 13, at the first blade 7*a* of the first forming shoe which is upwardly convex, and the first dewatering takes place. The successive blades 7*b* and the second forming shoe 8 are utilized as follows.

(a) In the case of information paper (PPC paper), the setting is conducted in the same manner as in the case of newsprint.

(b) In the case of thick coat paper, the setting is conducted in the same manner as the case of thin coat paper so that required paper quality can be obtained.

Figure 4:
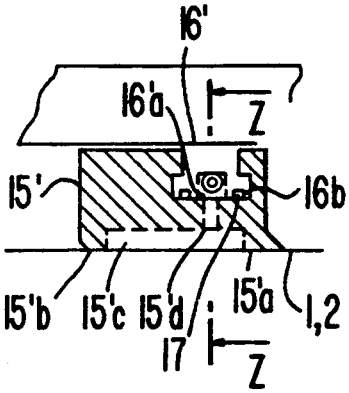
FIG. 4 is a longitudinal sectional view of the second forming shoe of the second embodiment of the present invention.
Figure 5:
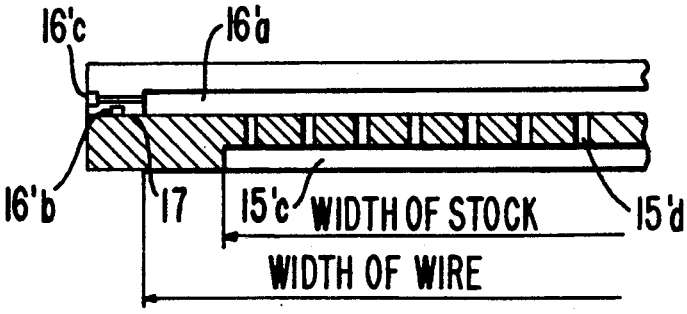
FIG. 5 is a cross-sectional view of the second forming shoe of the second embodiment of the present invention.
Figure 6:
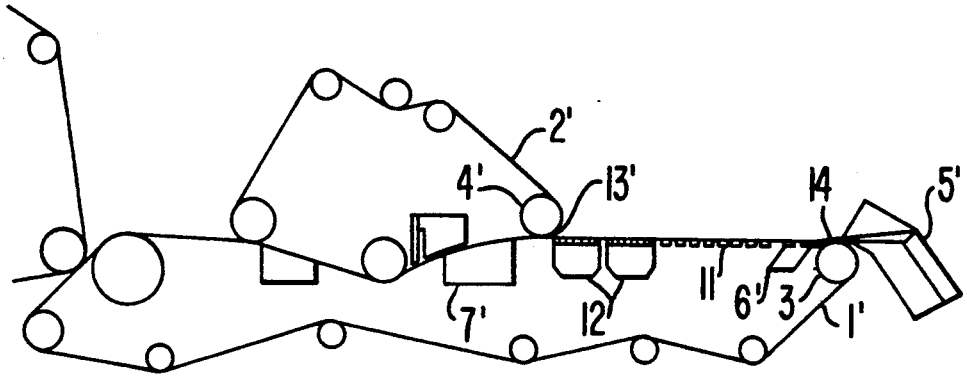
FIG. 6 (PRIOR ART)
FIG. 6 is a schematic view of a conventional hybrid type of twin-former.
Figure 7:
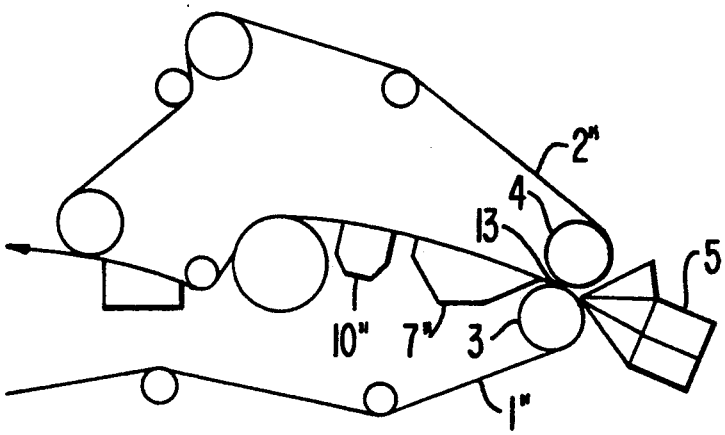
FIG. 7 (PRIOR ART)
FIG. 7 is a schematic view of a conventional gap former.

Referring now to FIG. 4 and FIG. 5, the second embodiment of the present invention will be explained. In this embodiment, the second forming shoe in the aforementioned first embodiment is structured as follows.

That is, a plurality of blades 15' of the second forming shoe are detachably supported. A T-bar 16' is used for a guide. The section of the blade 15' is rectangular. As shown in FIG. 5, the blade 15' is provided with a cut-out portion in the wire width direction, the length of which corresponds to the width of the stock. When the wires 1, 2 run along the blade 15', a space 15'*c* is formed. On the other hand, T-bar 16' is provided with a narrow long rectangular groove 16'*a* in the wire width direction, and a sealing groove 16'*b*. A sealing member 17 surrounds the rectangular groove 16'*a*. The space 15'*c* and the groove 16'*a* are connected by openings 15'*d* which are formed in the blade 15' in the wire width direction at appropriate intervals. A supply port 16'*c* used for supplying fluid (water or air) to prevent dewatering, is provided at the end of T-bar 16'.

In this embodiment, when fluid is injected from the supply port 16'*c* formed in T-bar 16', the groove 16'*a* and the space 15'*c* are filled with the fluid, and then the fluid is sealed by a fiber mat pinched by the two wires 1, 2, and the stock, so that pressure of the fluid is maintained to an amount which has been set in the outside. The blade 15' is pressed toward the T-bar 16' by wire tension and hydraulic pressure caused by the difference in area between the pressure chambers, so that a mating face of the aforementioned blade 15' and T-bar 16' is sealed by the sealing member 17 provided in the sealing groove 16'*b*.

When the stock pinched by the wires 1 and 2 passes the blade 15', the wires are bent by the rear end 15'*b* of the blade. Dewatering into the space 15'*c* caused when the wire is bent in the manner described above is inhibited by the enclosed fluid so that the same effect as that in the case of the blade 15 can be achieved. When clean water is supplied from the fluid supply port 16'*c* in the case where the former is not in operation, the inside can be cleaned without dismounting the blade 15'.

According to the present invention, a horizontal type of twin-wire former in a paper machine in which a loop-shaped top wire and bottom wire pinch the stock of paper run approximately horizontally to each other at an equal speed, is characterized in that a forming roll which guides the top wire is adjustable in up and down directions, and a forming board and a forming shoe on the downstream side in the running direction are provided in a loop of the bottom wire. Accordingly, the following effects can be provided.

1. The former can selectively operate in either a gap former mode or a hybrid former mode.

2. Paper quality can be obtained in accordance with the kind of paper.

3. Various kinds of paper, and paper of a wide range in basis weight can be made by one machine.

What is claimed is:

1. In a paper machine having a head box from which paper stock is ejected, a twin wire former for forming the stock into a web, said twin wire former comprising: a top loop of wire having an approximately horizontally extending run; a bottom loop of wire having an approximately horizontally extending run coacting with said run of the top loop of wire; a forming roll at an upstream end of the approximately horizontally extending run of said top loop of wire and over which said top loop travels and is guided, said forming roll being adjustably mounted in the twin wire so as to be movable in up and down directions toward and away from the bottom loop of wire; a forming board disposed within said bottom loop of wire and confronting the approximately horizontally extending run thereof, said forming board including a first blade defining a tip of the forming board at the upstream side thereof with respect to the direction of travel of the runs of the wires, and a plurality of successive blades disposed downstream of said first blade in said direction of travel, said first blade having an upper convex surface and a width as taken in said direction of travel greater than that of each of said successive blades, and said successive blades of the forming board having respective flat upper surfaces lying in a common plane; and a forming shoe disposed within said bottom loop of wire downstream of said forming board with respect to said direction of travel and also confronting the approximately horizontally extending run of said bottom loop, said shoe including a first blade defining a tip of the shoe at the upstream side thereof with respect to said direction of travel, and a plurality of successive blades disposed downstream of the first blade of the shoe in said direction of travel, the first blade of said shoe having an upper convex surface and a width in said direction of travel that is greater than that of each of said successive blades of the show, said successive blades of the shoe having upper convex surfaces lying in an arc having a radius of curvature that is greater than the radius of curvature of the upper surface of the first blade of said shoe.

2. A paper machine as claimed in claim 1, wherein the radius of curvature of the tip blade of said forming board is less than that of the tip blade of said forming shoe.

3. A paper machine as claimed in claim 1, wherein said forming roll is movable between a first position which forms a gap between the runs of the top and bottom loops of wire that terminates at the first blade of said forming board and a second position which forms a gap between said runs of the top and the bottom loops of wire terminating at the first blade of said forming shoe.

4. A paper machine as claimed in claim 2, wherein said forming roll is movable between a first position which forms a gap between the runs of the top and bottom loops of wire that terminates at the first blade of said forming board and a second position which forms a gap between said runs of the top and the bottom loops of wire terminating at the first blade of said forming shoe.

* * * * *